US009191735B2

(12) United States Patent
Andre et al.

(10) Patent No.: US 9,191,735 B2
(45) Date of Patent: Nov. 17, 2015

(54) MICROPHONE FEATURES RELATING TO A PORTABLE COMPUTING DEVICE

(75) Inventors: Bartley K. Andre, Menlo Park, CA (US); Matthew P. Casebolt, Fremont, CA (US); Mikael M. Silvanto, San Francisco, CA (US); Ron A. Hopkinson, Campbell, CA (US)

(73) Assignee: Apple Inc., Cupertino, CA (US)

( * ) Notice: Subject to any disclaimer, the term of this patent is extended or adjusted under 35 U.S.C. 154(b) by 631 days.

(21) Appl. No.: 13/492,707

(22) Filed: Jun. 8, 2012

(65) Prior Publication Data

US 2013/0329915 A1 Dec. 12, 2013

(51) Int. Cl.

| | |
|---|---|
| ***H04R 3/00*** | (2006.01) |
| ***H04R 1/40*** | (2006.01) |
| ***H04R 1/22*** | (2006.01) |
| ***H04R 1/28*** | (2006.01) |
| *H04R 9/08* | (2006.01) |

(52) U.S. Cl.

CPC ..... *H04R 1/406* (2013.01); *H04R 1/222* (2013.01); *H04R 1/28* (2013.01); *H04R 2499/11* (2013.01); *H04R 2499/15* (2013.01)

(58) Field of Classification Search

CPC ..... H04R 2499/11; H04R 3/005

USPC ..... 381/122, 355–365; 455/575.1–575.9

See application file for complete search history.

(56) References Cited

U.S. PATENT DOCUMENTS

| | | | | |
|---|---|---|---|---|
| 2005/0266872 | A1* | 12/2005 | MacIntosh et al. | 455/550.1 |
| 2007/0102267 | A1* | 5/2007 | Schentrup et al. | 200/5 A |
| 2008/0069389 | A1* | 3/2008 | Zhang et al. | 381/355 |
| 2009/0226021 | A1* | 9/2009 | Hawker et al. | 381/365 |

* cited by examiner

*Primary Examiner* — Vivian Chin
*Assistant Examiner* — Ammar Hamid
(74) *Attorney, Agent, or Firm* — Downey Brand LLP

(57) ABSTRACT

A portable computing device includes one or more microphones that function seamlessly with other components within the portable computing device. In one embodiment, a microphone opening is disposed on a side of the personal computing device and configured to be substantially perpendicular to a user. In another embodiment, a second microphone opening is disposed co-planar to the first microphone opening and positioned a predetermined distance apart. In another embodiment, one or more microphone openings can be disposed in a keyboard area and substantially between left and right sides of the portable computing device. In yet another embodiment, one or more microphone openings can be disposed underneath keycaps of the portable computing device.

20 Claims, 8 Drawing Sheets

Section A-A

Section A-A

MICROPHONE FEATURES RELATING TO A PORTABLE COMPUTING DEVICE

TECHNICAL FIELD

The present invention relates generally to portable computing devices. More particularly, the present embodiments relate to microphone arrays for portable computing devices.

BACKGROUND

Portable computing devices have grown in popularity and capability. Early uses for portable computing devices were often limited to simple computing tasks such as number manipulation and word processing. Present applications can include advanced graphical rendering, musical composition, movie and music presentation and more.

In order to support the ever expanding list of applications desired by users, portable computing devices are including more sophisticated components into the space defined by the enclosure of the device. While users expect more performance and features from their portable computing devices, users also want a compact unit; that is, users want the enclosure to be as compact as feasible.

Including a microphone in a portable computing device can be difficult, especially as the device becomes more compact and increased audio quality and capability is desired. As the portable computing device becomes smaller, internal component density increases which can result in a microphone implementation that can yield poor audio performance.

Therefore, it would be beneficial to provide a portable computing device that can support microphone capabilities within design constraints of the enclosure space.

SUMMARY

The present application describes various embodiments regarding systems and methods for incorporating microphone openings and microphones into a portable computing device. In one embodiment, a microphone assembly for a portable computing device can include a first microphone opening located on a base portion of a portable computing device, a first microphone and a first cavity coupling the first microphone and the first microphone opening. In one embodiment, the microphone opening can be perpendicular to the user. In another embodiment, a second microphone opening can be located co-planar to the first microphone opening and spaced a predetermined distance apart.

A microphone assembly is disclosed. The microphone assembly can include a first microphone opening and a second microphone opening located on a keyboard web of a portable computing device and substantially centered between the right and the left sides of the portable computing device.

A hidden microphone array is disclosed. The array can include a first and a second microphone opening located on a keyboard web of a portable computing device where the microphone openings are hidden underneath keycaps.

Other apparatuses, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and arrangements for the disclosed inventive apparatuses and methods for providing portable computing devices. These drawings in no way limit any changes in form and detail that may be made to the invention by one skilled in the art without departing from the spirit and scope of the invention. The embodiments will be readily understood by the following detailed description in conjunction with the accompanying drawings, wherein like reference numerals designate like structural elements, and in which.

DETAILED DESCRIPTION

Figure 1:
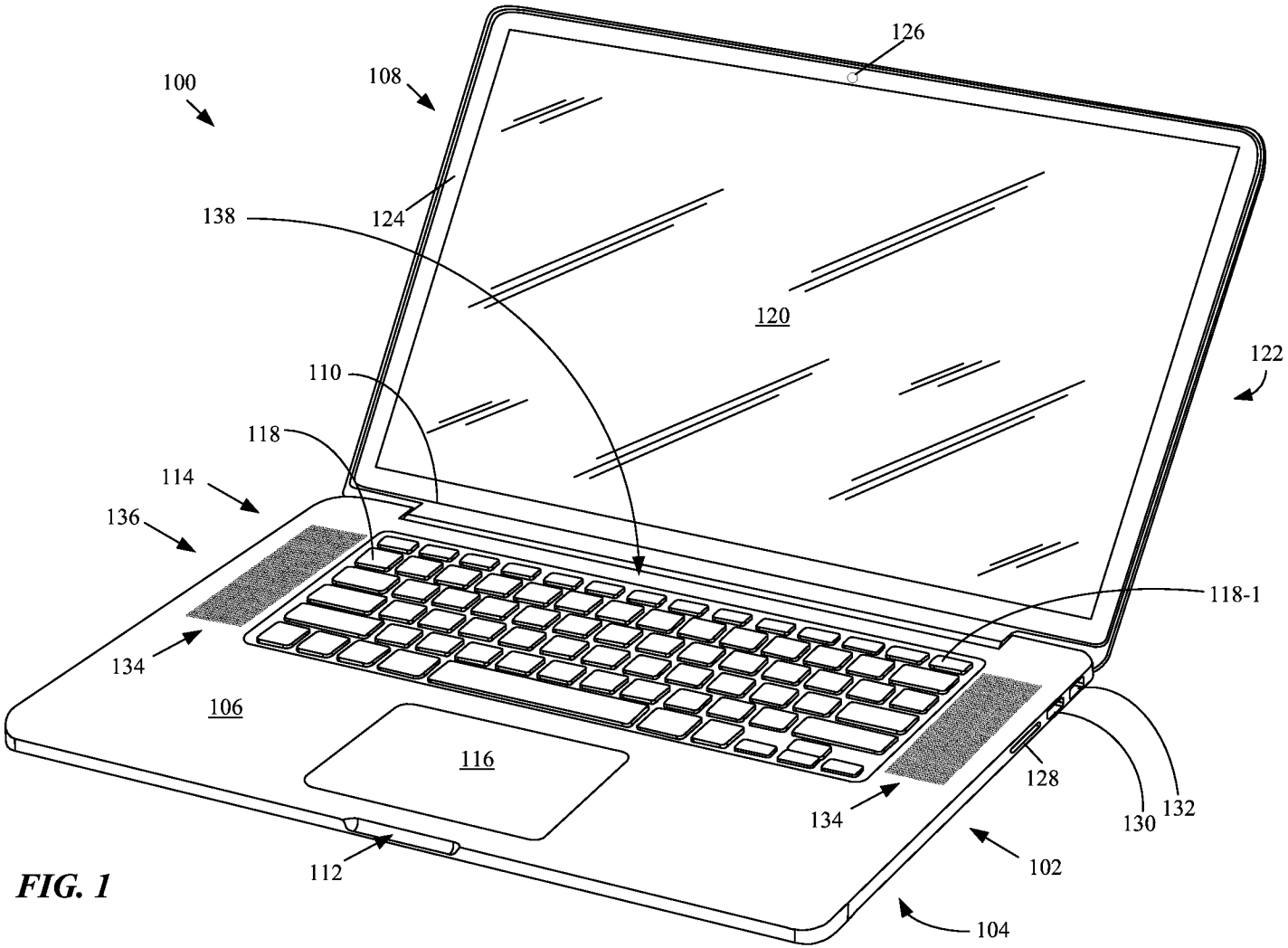
FIG. 1 shows a front facing perspective view of an embodiment of the portable computing device in the form of portable computing device in an open (lid) state.

Representative applications of apparatuses and methods according to the presently described embodiments are provided in this section. These examples are being provided solely to add context and aid in the understanding of the described embodiments. It will thus be apparent to one skilled in the art that the presently described embodiments can be practiced without some or all of these specific details. In other instances, well known process steps have not been described in detail in order to avoid unnecessarily obscuring the presently described embodiments. Other applications are possible, such that the following examples should not be taken as limiting.

The following relates to a portable computing device such as a laptop computer, net book computer, tablet computer, etc. The portable computing device can include a multi-part housing having a top case and a bottom case joining at a reveal to form a base portion. The portable computing device can have an upper portion (or lid) that can house a display screen and other related components whereas the base portion can house various processors, drives, ports, battery, keyboard, touchpad and the like. The base portion can be formed of a multipart housing that can include top and bottom outer housing components each of which can be formed in a particular manner at an interface region such that the gap and offset between these outer housing components are not only reduced, but are also more consistent from device to device during the mass production of devices. These general subjects are set forth in greater detail below.

The top case can also include one or more microphones to capture audio signals for recording or processing. Two or more microphones can be used together to determine an audio source direction that can be used to improve audio capture performance. In one embodiment, the spacing between two microphones can correspond to increasing sensitivity to audio signals centered about a selected frequency. In one embodiment, the selected frequency can be around 8 KHz, which can be in a human voice range.

In one embodiment, microphone holes for receiving audio signals can be located in a sideband of the top case. Microphone holes can be coupled to microphones through resonant cavities. The resonant cavities can shape a frequency response of the related microphones. In one embodiment, the resonant cavities can peak or boost the frequency response around 8 KHz. In another embodiment, microphone holes can be positioned on a keyboard web, approximately centered horizontally on the portable computing device. Microphones can be coupled to microphone holes through cavities. In one embodiment, a cavity can be formed within a fastener that can simultaneously be configured to attach a keyboard to the keyboard web. In yet another embodiment, microphone openings can be disposed on the keyboard web and can be hidden by keycaps.

These and other embodiments are discussed below with reference to FIGS. 1-8. However, those skilled in the art will readily appreciate that the detailed description given herein with respect to these figures is for explanatory purposes as the invention extends beyond these limited embodiments.

FIGS. 1-8 show various views of the portable computing device in accordance with various embodiments. FIG. 1 shows a front facing perspective view of an embodiment of the portable computing device in the form of portable computing device 100 in an open (lid) state. Portable computing device 100 can include base portion 102 formed of bottom case 104 fastened to top case 106. Base portion 102 can be pivotally connected to lid portion 108 by way of clutch assembly 110 hidden from view by a cosmetic wall. Base portion 102 can have an overall uniform shape sized to accommodate clutch assembly 110 and inset portion 112 suitable for assisting a user in lifting lid portion 108 by, for example, a finger. Top case 106 can be configured to accommodate various user input devices such as keyboard 114 and touchpad 116. Keyboard 114 can include a plurality of low profile keycap assemblies each having an associated key pad 118. In one embodiment, an audio transducer (not shown) can use selected portions of keyboard 114 to output audio signals such as music. In the described embodiment, a microphone can be located at a side portion of top case 106 that can be spaced apart to improve frequency response of an associated audio circuit.

Each of the plurality of key pads 118 can have a symbol imprinted thereon for identifying the key input associated with the particular key pad. Keyboard 114 can be arranged to receive a discrete input at each keypad using a finger motion referred to as a keystroke. In the described embodiment, the symbols on each key pad can be laser etched thereby creating an extremely clean and durable imprint that will not fade under the constant application of keystrokes over the life of portable computing device 100. In order to reduce component count, a keycap assembly can be re-provisioned as a power button. For example, key pad 118-1 can be used as power button 118-1. In this way, the overall number of components in portable computing device 100 can be commensurably reduced.

Touch pad 116 can be configured to receive finger gesturing. A finger gesture can include touch events from more than one finger applied in unison. The gesture can also include a single finger touch event such as a swipe or a tap. The gesture can be sensed by a sensing circuit in touch pad 116 and converted to electrical signals that are passed to a processing unit for evaluation. In this way, portable computing device 100 can be at least partially controlled by touch.

Lid portion 108 can be moved with the aid of clutch assembly 110 from the closed position to remain in the open position and back again. Lid portion 108 can include display 120 and rear cover 122 (shown more clearly in FIG. 2) that can add a cosmetic finish to lid portion 108 and also provide structural support to at least display 120. In the described embodiment, lid portion 108 can include mask (also referred to as display trim) 124 that surrounds display 120. Display trim 124 can be formed of an opaque material such as ink deposited on top of or within a protective layer of display 120. Display trim 124 can enhance the overall appearance of display 120 by hiding operational and structural components as well as focusing attention onto the active area of display 120.

Display 120 can display visual content such as a graphical user interface, still images such as photos as well as video media items such as movies. Display 120 can display images using any appropriate technology such as a liquid crystal display (LCD), OLED, etc. Portable computing device 100 can also include image capture device 126 located on a transparent portion of display trim 124. Image capture device 126 can be configured to capture both still and video images. Lid portion 108 can be formed to have uni-body construction that can provide additional strength and resiliency to lid portion 108 which is particularly important due to the stresses caused by repeated opening and closing. In addition to the increase in strength and resiliency, the uni-body construction of lid portion 108 can reduce overall part count by eliminating separate support features.

Data ports 128-132 can be used to transfer data and/or power between an external circuit(s) and portable computing device 100. Data ports 128-132 can include, for example, input slot 128 that can be used to accept a memory card (such as a FLASH memory card), data ports 130 and 132 can take be used to accommodate data connections such as USB, FireWire, Thunderbolt, and so on. In some embodiments, speaker grid 134 can be used to port audio from an associated audio component enclosed within base portion 102. In one embodiment, microphones for capturing audio can be located in microphone region 136. Although not shown in FIG. 1, in other embodiments, microphones for capturing audio can be located in region 138.

Figure 2:
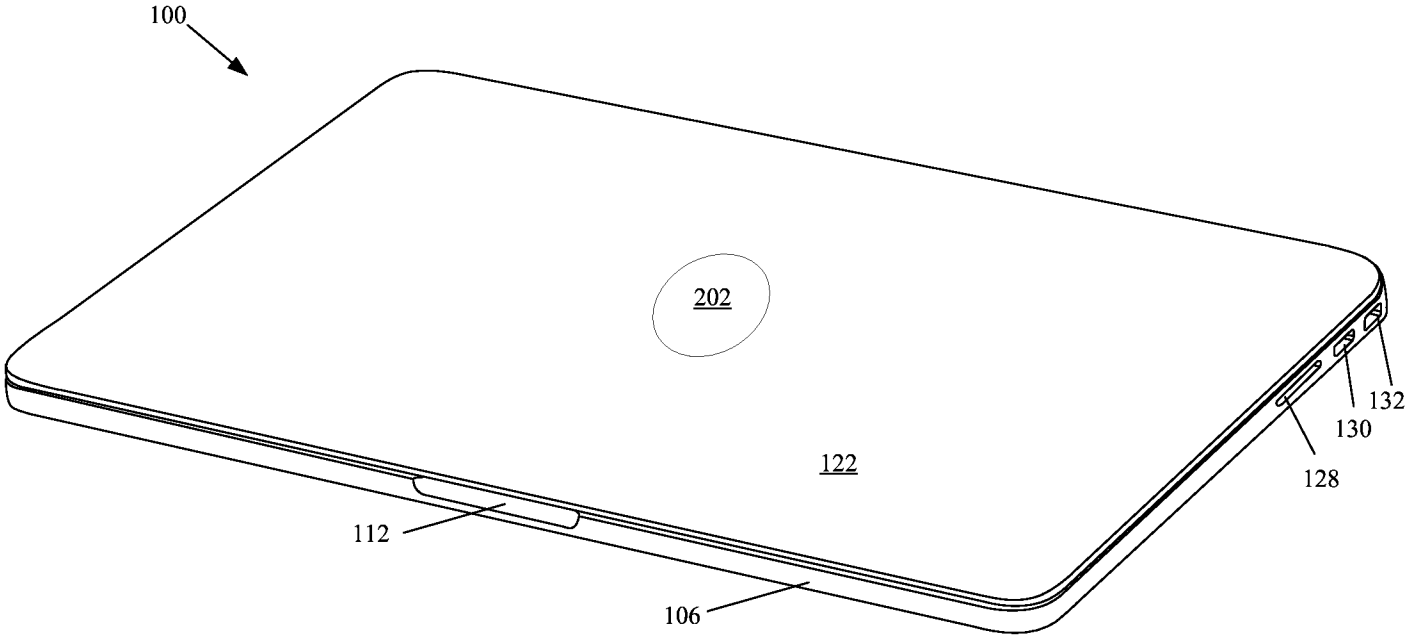
FIG. 2 shows portable computing device in a closed (lid) configuration that shows rear cover and logo.

FIG. 2 shows portable computing device 100 in a closed (lid) configuration that shows rear cover 122 and logo 202. In one embodiment, logo 202 can be illuminated by light from display 120. It should be noted that in the closed configuration, lid portion 108 and base portion 102 form what appears to be a uniform structure having a continuously varying and coherent shape that enhances both the look and feel of portable computing device 100.

Figure 3:
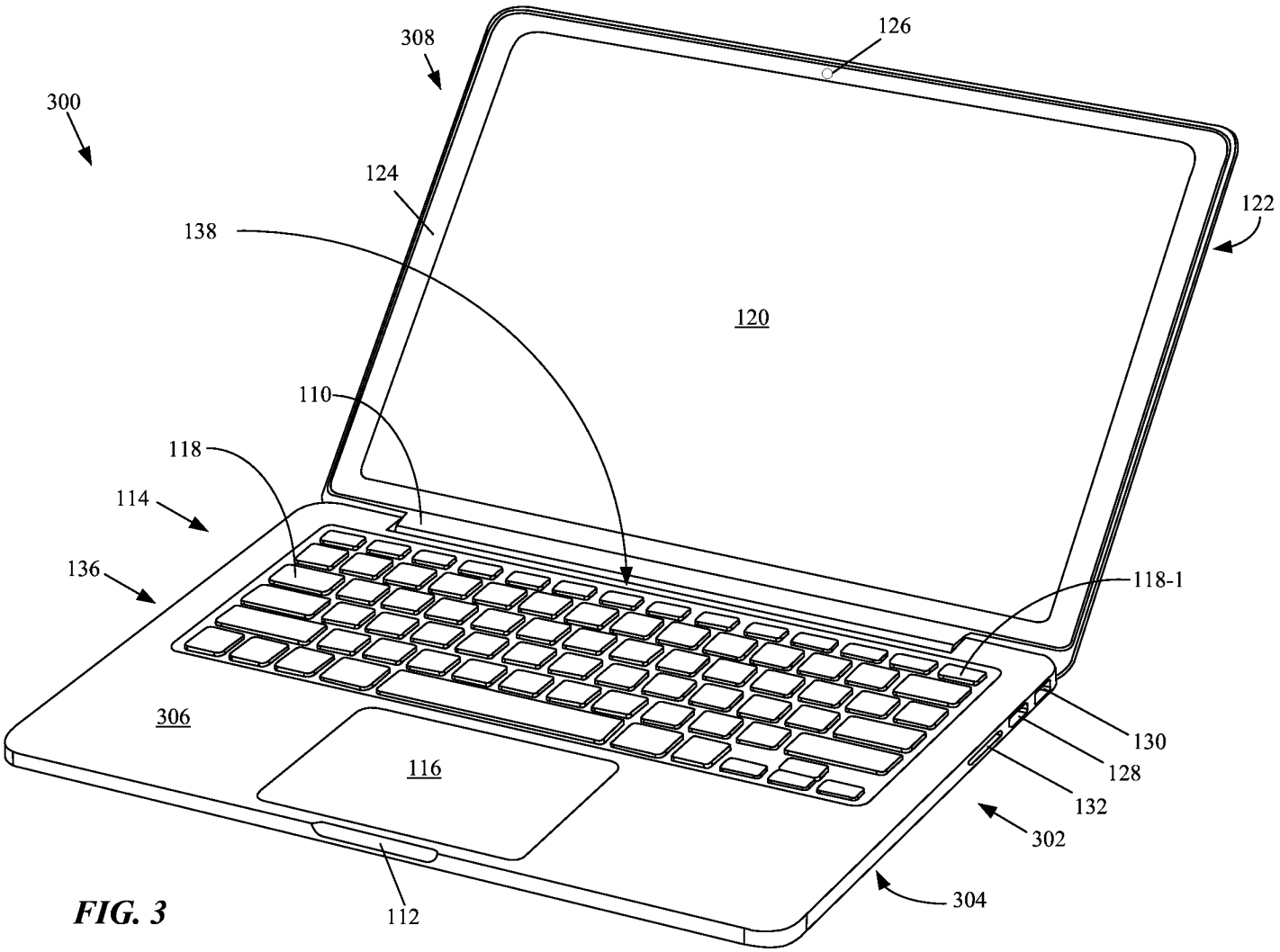
FIG. 3 shows another embodiment of the portable computing device in the form of portable computing device also in the open state.

FIG. 3 shows another embodiment in the form of portable computing device 300 that is smaller than portable computing device 100. Since portable computing device 300 is smaller in size than portable computing device 100, certain features shown in FIG. 1 are modified, or in some cases lacking, in portable computing device 300. For example, base portion 302 can be reduced in size such that separate speakers (such as speaker grid 134) are replaced with an audio port embodied as part of keyboard 114. However, bottom case 304 and top case 306 can retain many of the features described with regards to portable computing device 100 (such as display 120 though reduced to an appropriate size). Similar to FIG. 1, in one embodiment, microphones for capturing audio can be located in microphone region 136. Although not shown in FIG. 3, in other embodiments, microphones for capturing audio can be located in region 138.

Figure 4:
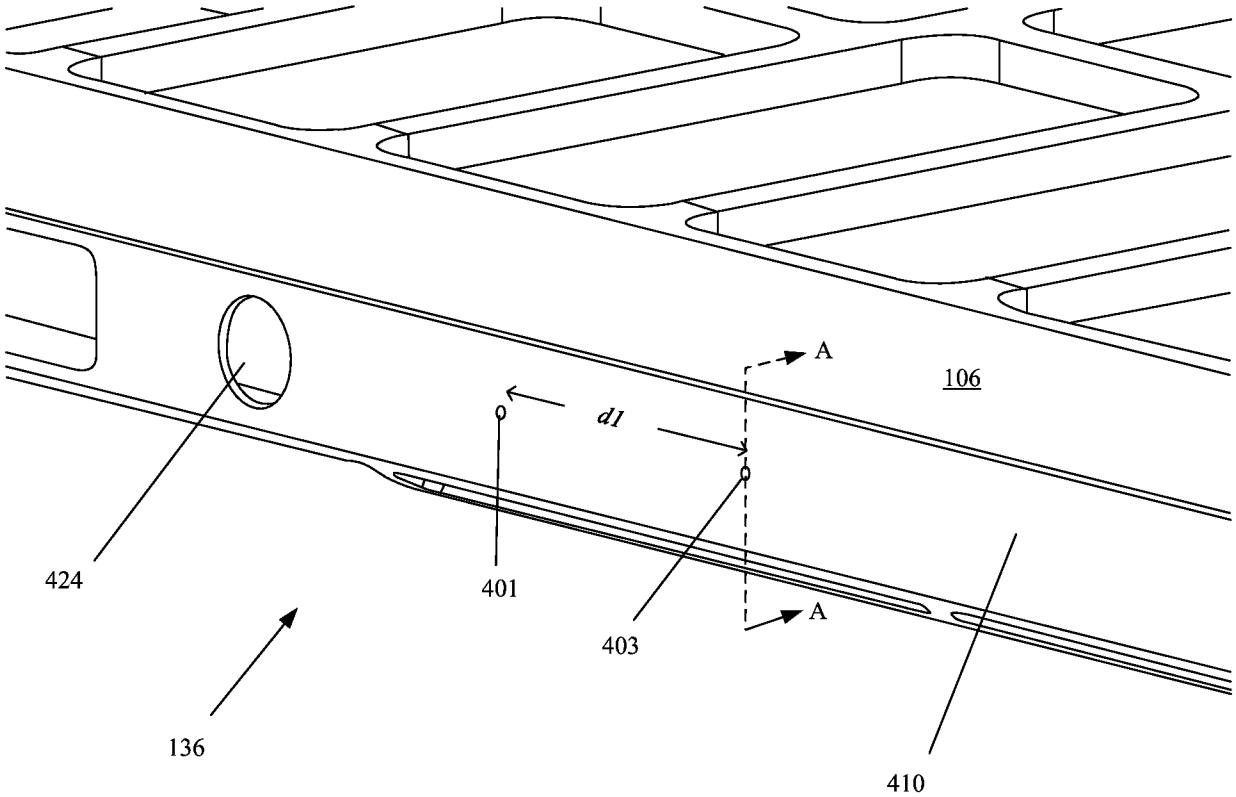
FIG. 4 shows microphone region of top case.

FIG. 4 shows microphone region 136 of top case 106 having first microphone opening 401 and second microphone opening 403 suitable for receiving audio signals. In this embodiment, microphone openings 401, 403 are disposed on sideband 410 of top case 106 and spaced apart distance "d1" in order to facilitate error correction in speech recognition algorithms. Distance d1 can vary depending upon a desired frequency response. For example, distance d can be on the order of about 15 mm. In other embodiments, microphone openings 401, 403 can be spaced apart a distance between 10 and 30 mm. In one embodiment, microphone openings 401 and 403 can be substantially perpendicular to users of portable computing device 100. Such a positioning of microphone openings can advantageously remove the openings from a line of sight of the user. Microphone openings 401, 403 can be substantially centered vertically (as shown) on side of top case 106. In one embodiment, microphone openings 401, 403 can take the form of an ellipse. In another embodiment, openings 401 and 403 can be substantially circular. Although not readily apparent from FIG. 5, microphone openings 401, 403 can be part of an internal microphone system. In one case, the microphone openings 401, 403 can lead to audio ports (cavities) that lead to an audio circuit having a transducer for converting audio signals (in the form of a voice, for example) into digital data for subsequent processing. The audio ports can be formed as part of top case 106. In other embodiments, more than two microphone openings can be disposed on sideband 410. In those embodiments, spacing between microphone openings need not be equal, but can be different. For example the distance between a first and a second microphone opening can be 15 mm, while the distance between the second and a third microphone opening can be 20 mm. Different microphone opening spacing can enable different available frequency responses compared to an embodiment with only two microphones. Top case 106 can also include an opening for a headphone jack 424.

Figure 5A:
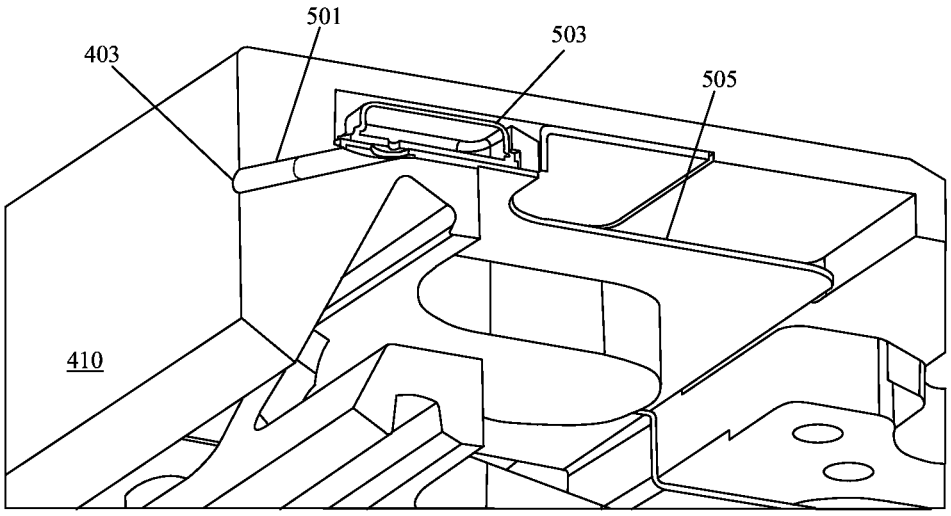
FIGS. 5A-5B are cross section views of microphone openings from FIG. 4.
Figure 5B:
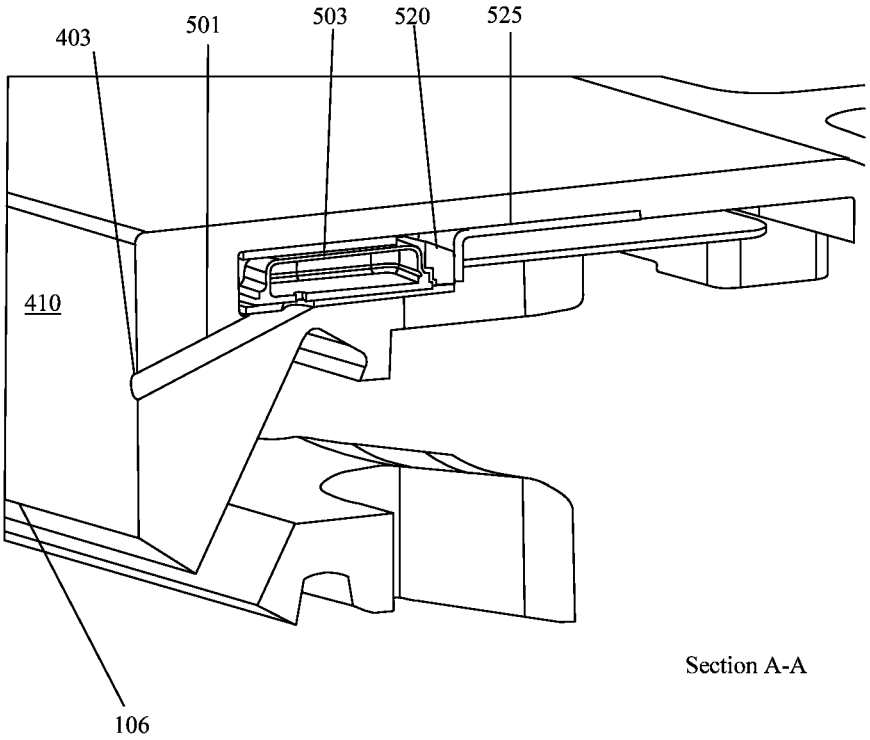

FIGS. 5A-5B are cross section views of microphone openings 401, 403 from FIG. 4. FIG. 5A in particular, is a bottom view of cross section A-A. Although FIG. 5A is a cross section of microphone opening 403, cross section of microphone opening 401 can be substantially similar. Microphone opening 403 is shown on sideband 410. In one embodiment, the diameter of cavity 501 is 0.5 millimeters. In other embodiments, the diameter of cavity 501 can range from 0.5 to 1.00 mm. Other embodiments can include other diameters. Microphone 503 can be aligned with cavity 501 such that the opening of microphone 503 can be substantially centered with cavity 501. In one embodiment, cavity 501 can act as a resonant cavity coupling microphone opening 403 to microphone 503. The resonant cavity can affect, at least in part, a frequency response of microphone 503. Microphone 503 can be attached to a substrate 505 and couple signals from microphone 503 to other devices or circuits. Substrate 505 can be a printed circuit board, flexible circuit, rigid flex or any other technically feasible substrate. In one embodiment, microphone 503 can be sealed to cavity 501 to improve acoustic performance and reduce sensitivity to stray noise.

FIG. 5B shows a top view of cross section A-A from FIG. 5. Microphone opening 403 is shown on sideband 410. Microphone 503 can be positioned with respect to top case 106, by carrier 520, mounting flange 525 or a combination of both. In one embodiment, cavity 501 can be configured at an angle with respect to sideband 403. In one embodiment, cavity 501 can be fifteen degrees in elevation with respect to a top or bottom surface of top case 106. In one embodiment, microphones associated with both first and second microphone openings 401 and 403 can be configured substantially similar to the configuration shown FIGS. 5A-5B. By configuring the microphone openings 401, 403, related cavities and related microphones substantially similar, acoustic performance aspects of individual microphones can be substantially similar, enhancing the performance of a microphone array based on microphones coupled to first and second microphone openings 401, 403. In one embodiment, microphone openings 401 and 403 can be co-planar on sideband 410.

Figure 6:
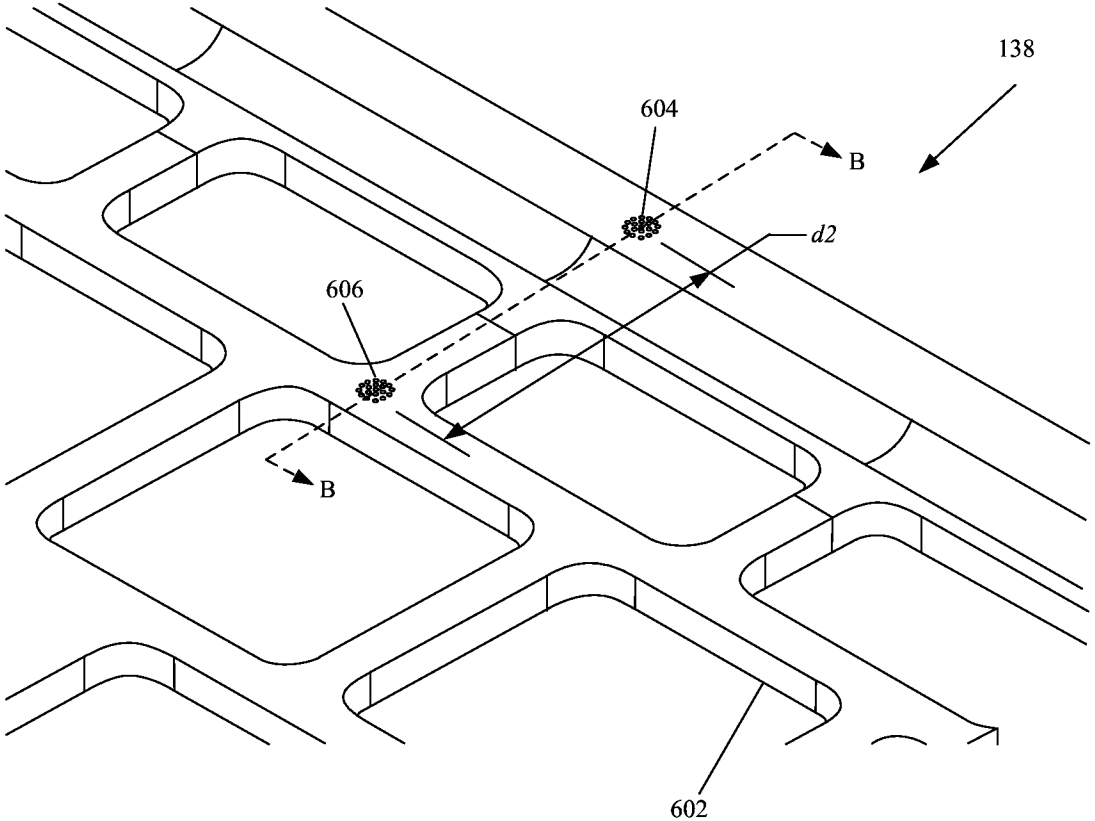
FIG. 6 shows microphone region of top case.

FIG. 6 shows microphone region 138 of top case 106 in accordance with one embodiment of the specification. Microphone region 138 can be disposed on keyboard web 602. The exemplary embodiment shown in FIG. 6 shows two microphone openings positioned on keyboard web 602. In one embodiment, the distance d separating first microphone opening 604 and second microphone opening 606 can be between 15 and 20 mm. First microphone opening 604 can be disposed toward one edge of keyboard 602, adjacent to the area for keyboard 114. Second microphone opening 606 can be positioned between key openings on keyboard web 602. In one embodiment, microphone openings 604 and 606 can be centered horizontally on keyboard web 602 such that microphone openings 604 and 606 can be substantially equally distant from right and left edges of the portable computing device 100. This microphone position can advantageously center the microphone openings 604 and 606 substantially in-line with the user.

Microphone separation distance d2 between first microphone opening 604 and second microphone opening 606 can be selected to enable microphones coupled to first 604 and second 606 microphone openings to increase a frequency response in a frequency band. In one embodiment, a separation of 15 mm can enhance a frequency response around 8 KHz, which can be a frequency related to human voices.

Figure 7A:
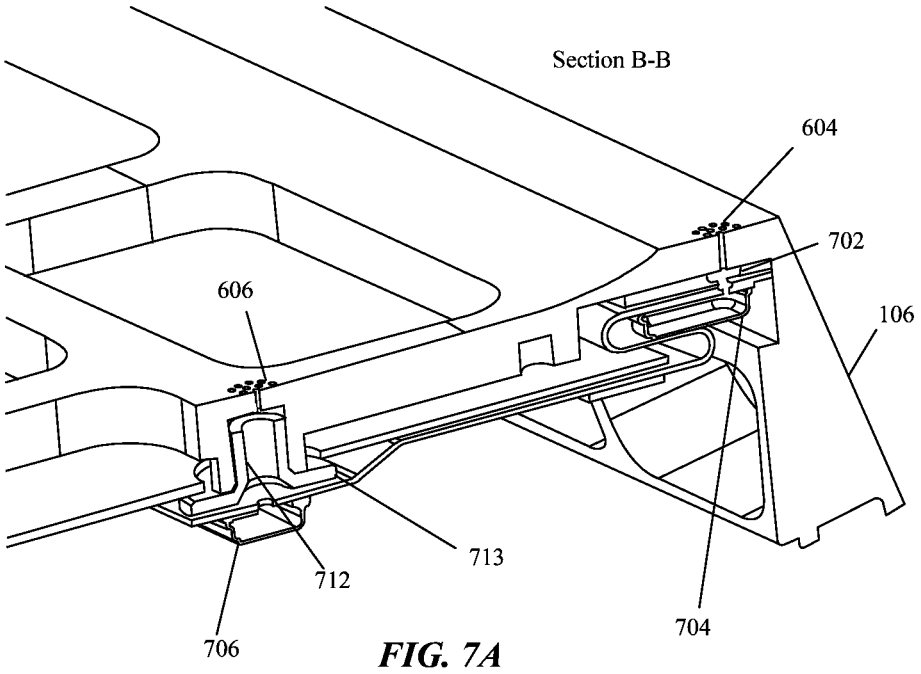
FIGS. 7A and 7B are cross section views of microphone openings shown in FIG. 6.
Figure 7B:
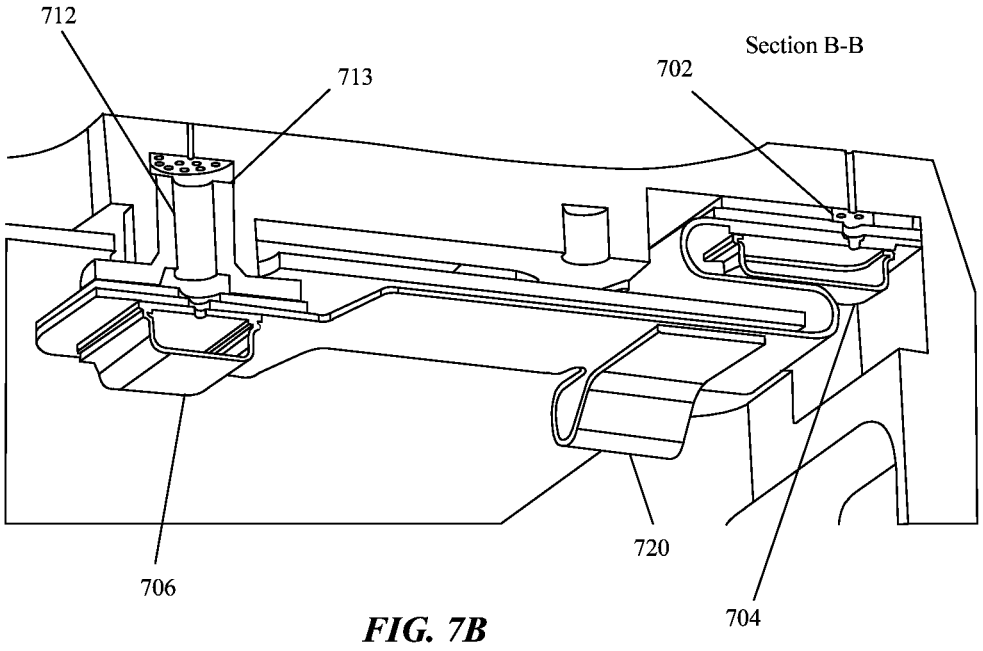

FIGS. 7A and 7B are cross section views of microphone openings shown in FIG. 7. FIG. 7A shows cross section B-B, as viewed from the top of keyboard web 602. Keyboard web 602 can include first microphone opening 604 and second microphone opening 606. First microphone 704 can be aligned with first microphone opening 604. In one embodiment, first cavity 702 can be disposed between and couple first microphone 704 to first microphone opening 604 and first cavity 702 can also function as a resonant cavity to shape an audio frequency response of the first microphone 704. In one embodiment, first cavity can be formed keyboard web 602.

Second microphone 706 can be aligned with second microphone opening 606. Second cavity 712 can couple second microphone 706 to second microphone opening 606. In one embodiment, second cavity 712 can be formed by fastener 713 where a central portion of the fastener 713 is removed. In one embodiment, fastener 713 can be a machined screw. The fastener 713 can be used to attach a keyboard assembly to the top case 106 as well as act as second cavity 712. In one embodiment, the dimensions of the central portions of fastener 713 can define, at least in part, related resonant cavity characteristics.

FIG. 7B is a bottom view of cross section B-B from FIG. 7. First cavity 702 and second cavity 712 are shown. First microphone 704 and second microphone 706 can be affixed to a common substrate 720 to ease manufacturing and help route microphone signals. The substrate 720 can be a flex circuit, rigid flex circuit, or any other technically feasible substrate. In one embodiment, first microphone 704 and second microphone 706 can be sealed to first cavity 702 and second cavity 712 respectively to increase acoustic performance and reduce sensitivity to stray noise sources.

Figure 8:
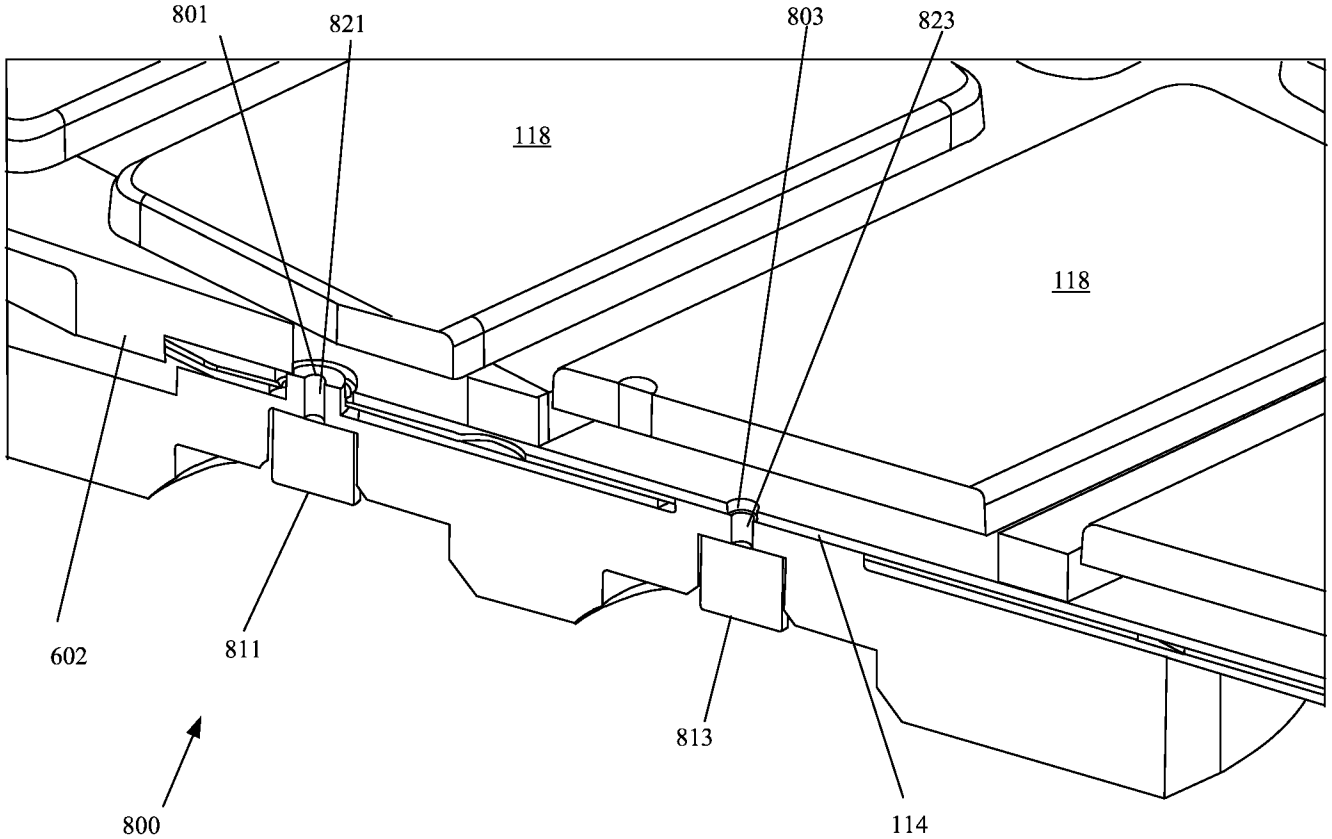
FIG. 8 is a cross section view of another embodiment of a microphone region on top case.

FIG. 8 is a cross section view of another embodiment of a microphone region 800 on top case 106. In this embodiment, microphone openings 801 and 803 can be placed underneath keycaps 118 of a keyboard 114 of portable computing device 100. First microphone 811 and second microphone 813 can be disposed underneath keyboard web 602. In one embodiment, first and second microphone openings 801 and 803 can be spaced 15 millimeters apart. In other embodiments, microphone spacing can be between 10 and 30 millimeters apart. First cavity 821 can couple first microphone 811 to first microphone opening 801 and second cavity 823 can couple second microphone 813 to second microphone opening 803. In one embodiment, cavities 821 and 823 in keyboard web 602 can also serve, at least in part, as resonant cavities to help shape the frequency response of microphones 811 and 813. As shown, microphone openings 801 and 803 can be advantageously hidden underneath keycaps 118.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A portable computing device, comprising:

a base portion, comprising a wall that defines a microphone opening;

a fastener, comprising:

a first end, comprising threading that secures the fastener to the wall, and a second end opposite the first end, the fastener defining a channel extending from the first end to the second end; and a microphone coupled with the second end of the fastener and configured to receive audio signals transmitted through the microphone opening and the channel.

2. The portable computing device of claim 1, wherein the fastener comprises a screw.

3. The portable computing device of claim 1, wherein the fastener secures a keyboard assembly to the wall.

4. The portable computing device of claim 1, wherein the microphone opening is a first microphone opening and the microphone is a first microphone.

5. The portable computing device of claim 4, further comprising:

a second microphone opening defined by the wall;

a second microphone configured to receive audio signals through the second microphone opening.

6. The portable computing device of claim 5, wherein both the first and second microphone openings each comprise a plurality of openings extending through the wall.

7. The portable computing device of claim 5, wherein the first microphone opening is about 15 millimeters from the second microphone opening.

8. The portable computing device of claim 5, wherein a predetermined distance between the first and second microphone openings increases a directional sensitivity in a predetermined direction.

9. An electronic device, comprising:

a housing defining a cavity that accommodates electrical components of the electronic device, the housing comprising a wall defining a first microphone opening having a length that is substantially greater than a diameter of its cross-section taken perpendicular to the length, a second microphone opening having a length that is substantially greater than a diameter of its cross-section taken perpendicular to the length and an undercut region within the cavity;

a first microphone coupled to a portion of the wall adjacent to the first microphone opening and positioned within the undercut region defined by the wall; and a second microphone coupled to the wall proximate the second microphone opening.

10. The electronic device of claim 9, wherein the wall comprises an interior surface that defines both a portion of the undercut region and one end of the first microphone opening, and wherein the first microphone is coupled with the interior surface.

11. The electronic device of claim 9, wherein a flexible circuit that transmits audio information from the first microphone to at least one of the electrical components is positioned between the first microphone and the first microphone opening.

12. The electronic device of claim 9, wherein the wall is a side wall of the housing.

13. The electronic device of claim 12, wherein the first and second microphone openings extend through the wall at a downward sloping angle.

14. The electronic device of claim 13, wherein both the first and second microphone openings extend through the wall at the same downward sloping angle.

15. The electronic device of claim 13, wherein the first and the second microphones are sealed to the first and the second microphone openings.

16. The electronic device of claim 15, further comprising a flexible circuit that electrically couples the first microphone to the second microphone.

17. A microphone array comprising:

a housing wall defining a keyboard web, a first microphone opening and a second microphone opening of a portable computing device, the housing wall comprising an exterior cosmetic surface and an interior facing surface; and a first microphone and a second microphone coupled with the interior facing surface of the housing wall proximate the first microphone and second microphone opening respectively, wherein a portion of the exterior cosmetic surface defining the first microphone opening is recessed with respect to a portion of the exterior cosmetic surface defining the second microphone opening.

18. The microphone array of claim 17, wherein the first microphone is coupled with the interior facing surface by way of a screw secured directly to the interior facing surface.

19. The microphone array of claim 18, wherein a central portion of the screw is removed to form a channel that transmits waves from the first microphone opening to the first microphone.

20. The microphone array of claim 17, wherein the keyboard web comprises a number of openings disposed within the recessed portion of the exterior cosmetic surface that accommodate keys of a keyboard assembly.

* * * * *